United States Patent [19]

Stahlherm et al.

[11] 4,240,877

[45] Dec. 23, 1980

[54] METHOD FOR PREHEATING COAL FOR COKING

[75] Inventors: Dieter Stahlherm, Recklinghausen; Gerhard Rutkowski, Mülheim an der Ruhr; Janos Bocsanczy, Recklinghausen; Hans Becker, Tönisvorst, all of Fed. Rep. of Germany

[73] Assignee: Firma Carl Still GmbH & Co. KG, Fed. Rep. of Germany

[21] Appl. No.: 35,205

[22] Filed: Apr. 30, 1979

[30] Foreign Application Priority Data

May 2, 1978 [DE] Fed. Rep. of Germany ..... 2819232

[51] Int. Cl.[3] ..... C10B 57/10; C10B 31/00; C10B 57/08

[52] U.S. Cl. ..... 201/41; 55/21; 201/1; 201/16; 201/42; 202/150; 432/58

[58] Field of Search ..... 201/13, 16, 41, 43, 201/1, 42; 202/150; 432/58; 55/21; 209/144

[56] References Cited

U.S. PATENT DOCUMENTS

| | | | |
|---|---|---|---|
| 2,658,862 | 11/1953 | Horner | 202/150 X |
| 2,963,152 | 12/1960 | Leslie et al. | 209/139 R X |
| 3,669,265 | 6/1972 | Conley | 209/144 |
| 3,793,743 | 2/1974 | Kemmetmueller | 432/58 X |
| 3,843,458 | 10/1974 | Kemmetmueller | 202/150 X |
| 3,884,620 | 5/1975 | Rammler | 432/58 X |
| 3,888,742 | 6/1975 | Kemmetmueller | 202/150 X |
| 3,992,266 | 11/1976 | Aktay et al. | 201/41 X |
| 4,055,486 | 10/1977 | Choi et al. | 209/11 |
| 4,139,419 | 2/1979 | Limberg | 201/41 X |

FOREIGN PATENT DOCUMENTS 2647079 4/1978 Fed. Rep. of Germany ..... 201/41

*Primary Examiner*—Frank W. Lutter
*Assistant Examiner*—Roger F. Phillips
*Attorney, Agent, or Firm*—McGlew and Tuttle

[57] ABSTRACT

A method of preheating coal for coking comprises bringing a hot operating gas into direct contact with the coal to preheat the coal. Both the coal and the operating gas are passed into a separator and the separator is operated so as to effect the separation of the coarse preheated coal for delivery to the coke oven from the operating gases and coal dust. The operating gases and coal dust are then passed into a deduster to remove the coal dust from the operating gases. A portion of the removed dust is continuously directed into an accumulator. The dust is either supplied from the deduster or the accumulator to a combustion furnace where it is burned to generate at least a portion of the operating gas. The amount of coal dust which is accumulated in the accumulator is checked regularly and the separator is operated so as to produce sufficient dust to maintain a desired operating level in the accumulator so that dust will always be available in a sufficient quantity to operate the combustion chamber for supplying the operating gases.

6 Claims, 3 Drawing Figures

METHOD FOR PREHEATING COAL FOR COKING

FIELD AND BACKGROUND OF THE INVENTION

This invention relates to coking in general and, in particular, to a new and useful method of preheating coal for coking by bringing it into direct contact with a hot operating gas and, wherein, the operating gases, after it is separated from the coal which is passed to the coking furnace, is dedusted and the coal collected from the dedusting is accumulated and delivered to a burner for generating at least a portion of the operating gases and the amount of coal in the accumulator is used as a regulator of the separator for separating the gases from the coal after they preheat it.

DESCRIPTION OF THE PRIOR ART

Methods of preheating coal are known from German AS No. 1,923,494 and German OS No. 2,415,758. A development of these methods to the effect of burning the fine coal dust obtained during the dedusting, and using a combustion gas as the heating or operating gas for the preheating, has been provided in the published German Patent Application No. 2,719,189.

Of the various known methods of preliminary coal treatment, such as ramming, briquetting and preheating, the preheating thereof is becoming the most important consideration. Advantages of preheating coal prior to its charging into the oven chambers are primarily the increase of bulk density by 10% to 15%, increase of the coke strength (M40) by up to 20%, the reduced heat consumption in the coke ovens, and a throughput rate augmented by up to 50%.

One problem arising with the preheating and coking of coals which are ordinarily ground to a very fine size, for example, 90 to 95% up to 3 mm, is the occurrence of superfine dust which must be separated and collected in special dust separators after the bulk of the preheated coal has been separated from the operating gas stream. The particular problem is that the amount of the superfine coal dust is not constant, and accordingly, it may happen that the amount obtained is smaller than that needed for producing the hot operating gas. In such instances, additional fuel must be provided for operating the system and additional installation is necessary for storing the fuel and feeding it automatically into the furnace as soon as the coal dust supply becomes insufficient. This increases the costs considerably.

It may also happen, however, that too much dust is obtained and the entire amount cannot be employed in the production of operating gas. This coal dust in excess, which is normally not too large a quantity is then simply mixed to the preheated coal to be coked to avoid complications. While charging the coal into the oven chambers, but also during the first phase of carbonization, larger amounts of this superfine dust are taken off the chambers again by the filling gases and the coke oven gases and pass into the collecting main where they are partly deposited along with the condensates and distributed between condensate water and the tar, whereby, the tendency of water and tar to form emulsions is increased. Special separating tanks are then needed for a satisfactory separation of tar and water. In addition, a part of the coal dust remains inseparably in the tar, making it practically unusable. It may be destroyed by combustion, for example, that part of the fine coal dust which remains in the gas is carried off with the gas stream through the entire gas treating plant.

On the other hand, it is difficult to find uses for the small excess amounts of coal dust and the necessity of depositing it or even of transporting it to a remote use arises. This again causes expenses which reduce the economy of the entire process.

It would therefore be technologically progressive to be able to adjust the occurrence of superfine dust to an amount which always corresponds to the quantity of fuel needed in the plant for producing the operating gas. For this purpose, the invention is directed to a method which ensures that such an amount of fine dust coal for the production of operating gases is available in a satisfactory quantity and with a satisfactory temperature at any time it is needed, but not more than is needed.

SUMMARY OF THE INVENTION

In accordance with the invention, coal is preheated for use in a coking process by bringing a hot operating gas into direct contact with the coal. After the gases contact with the coal so as to preheat it, it is passed into a separator and the preheated coal is then directed to the coking oven and the gas, together with the coal dust, is directed to a further separator or deduster where the coal dust is removed from the operating gases. This dust is stored in an accumulator and the separation of the operating gases from the coal that is preheated is carried out with a separation degree or fine separation controlled by the amount of coal which is accumulated and the accumulation is carried out to a degree to ensure that the accumulator and dust coal will be sufficient to continuously operate the burner for generating at least a portion of the operating gases by combustion of the dedusted coal.

In the variation with indirect heating, even steam alone or in a mixture with an inert gas may be used as the operating gas, as provided in German Patent Application No. P 26 47 079. For example, to start the process, any available inert gas may be used which then, in full operation, i.e., upon attaining the operating temperature, is gradually replaced by circulated steam. As a rule, upon reaching normal operational conditions, the operating gas predominantly comprises steam.

Further, it may also be advantageous to adjust the separation of coal dust to an amount by which, upon burning, a heat quantity is generated which covers not only the necessary supply for the operating gas production, but also an additional production of steam corresponding to the amount of water removed from the coal during the preheating, which steam is then supplied to the coke oven gas-collecting main of the coking plant, in accordance with German Patent Appln. No. P 26 47 079.

By providing further operational steps known per se, the economy of the entire process may be optimized. For example, with a single stage preheating of the coal, a waste gas is obtained having a temperature of about 250° C. to 300° C. This residual heat may be utilized to heat the combustion air for the fine coal dust by indirect heat exchange up to 200° C.

While preheating the coal in several stages and heating the operating gas directly, the waste gases have temperatures of about 80° C. to 150° C. which are very close to the dewpoint of sulfurous acid and may easily cause corrosion in the apparatus. Now, prior to recycling or allowing them to escape into the atmosphere, such waste gases may again be reheated to about 200° C. The separated fine coal dust may also be used for this purpose. Only the degree of separation must be adjusted to a correspondingly high level.

To start the plant and hold it at its operating temperature, a sulfur-free fuel is preferred, since this eliminates the risk of corrosion by acid condensates. For the entire process, coal which is poor in sulfur is, of course, particularly advantageous.

To separate fine dust from the waste gas stream of the preheating plant, dry or wet scrubbing methods may be provided. In such purification, water containing coal mud is obtained which is dried and reused in the entire process and burned. The waste or excess heat produced in the entire process is preferably employed for such drying of the mud.

Accordingly, an object of the present invention is to provide a method of preheating coal for coking which comprises bringing a hot operating gas into direct contact with the coal to preheat the coal, passing the coal and the operating gas into a separator and operating the separator so as to effect the separation of coarse preheated coal for delivery to the coke oven and the operating gases and coal dust, and passing the operating gases and the coal dust into a deduster to remove the coal dust from the operating gases, directing a portion of the dust continuously into an accumulator and burning at least a portion of the dust either from the accumulator or from the separator to generate at least a portion of the operating gases, sensing the amount of coal dust in the accumulator and regulating the separation of the operating gases from the heated coal so as to produce sufficient dust which is delivered to the accumulator to maintain it at a predetermined level for use in generating combustion gases.

A further object of the invention is to provide a device for preheating coal for coking, which includes an accumulator connected to a separator for operating gases and coal dust and wherein means are provided for accumulating a predetermined amount of coal dust and for regulating a separator for the combustion gases and the preheated coal so as to produce sufficient coal dust to operate a burner for generating at least a portion of the operating gases.

Another object of the present invention is to provide a device for preheating coal for coking, which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
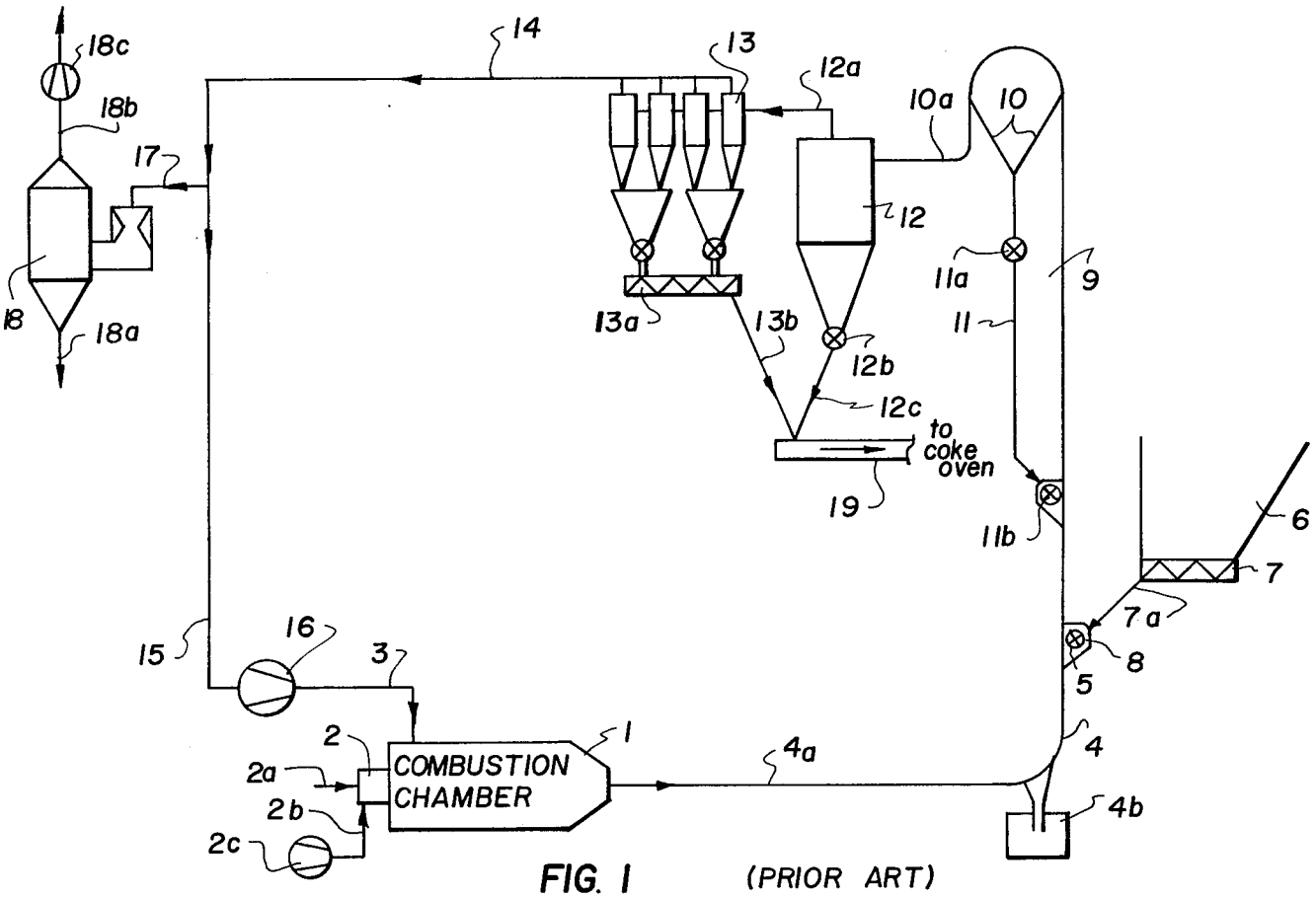
FIG. 1 is a diagrammatic view of a device for preheating coal for coking constructed in accordance with the Prior Art.
Figure 2:
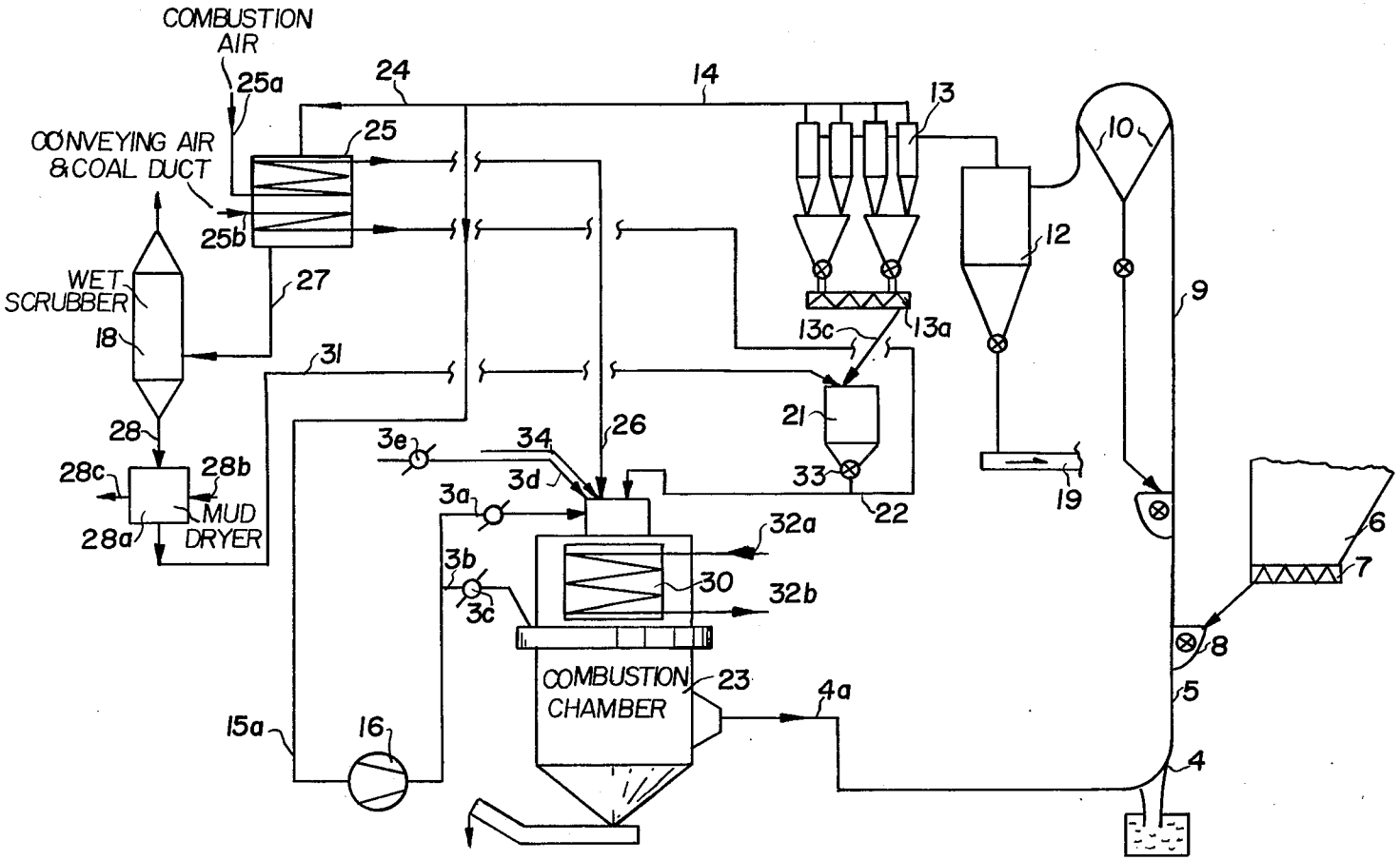
FIG. 2 is a view similar to FIG. 1 indicating an improved method of preheating coal for coking in accordance with the invention.
Figure 3:
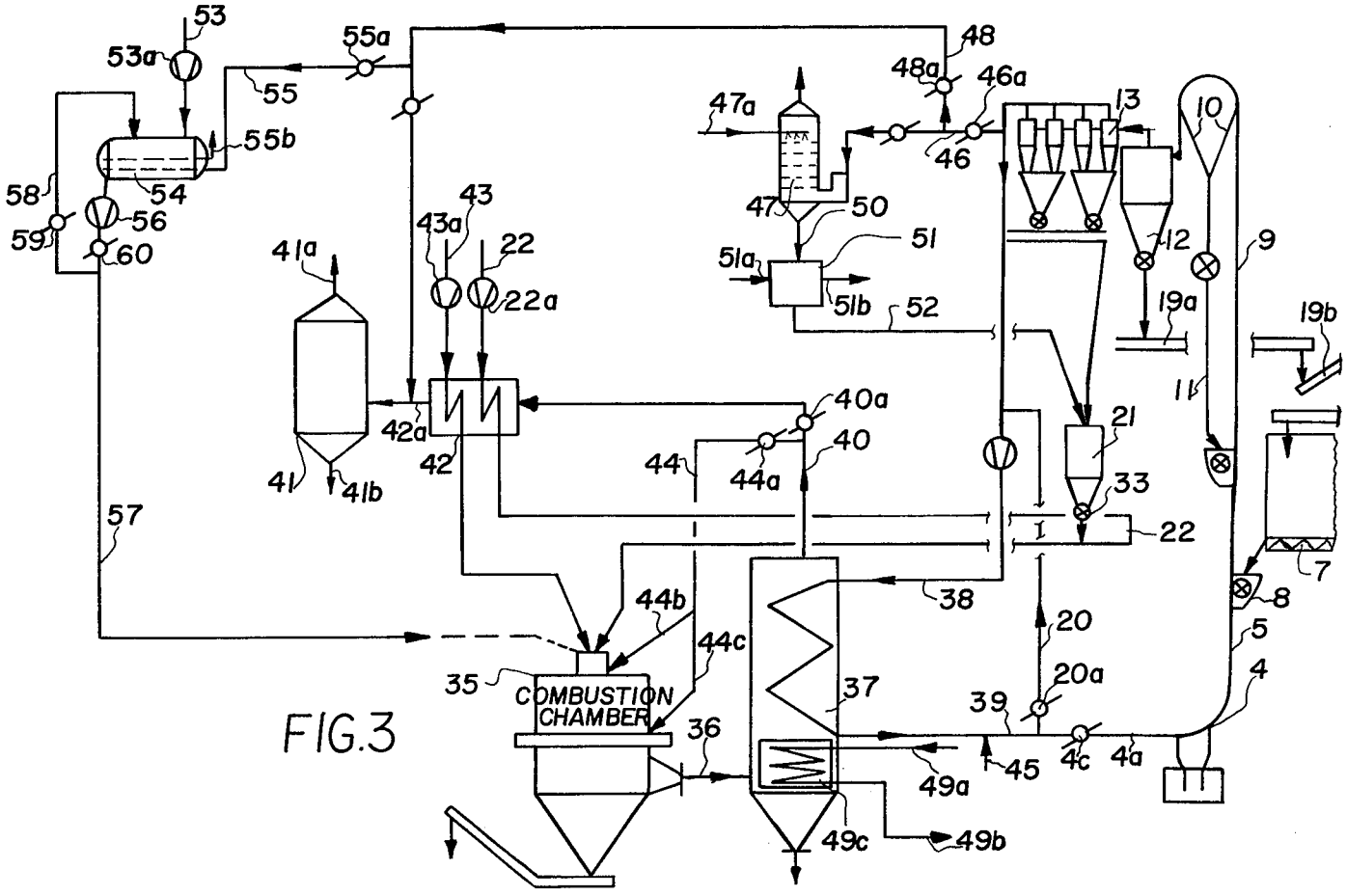
FIG. 3 is a view similar to FIG. 2 indicating another embodiment of apparatus for preheating coal for coking constructed in accordance with the present invention.

Referring to the drawings in particular, the invention embodied therein is included on a device for preheating coal for coking similar to that shown in FIG. 1 for the Prior Art, which has been improved in accordance with the invention as indicated in the embodiments of FIGS. 2 and 3.

In FIG. 1, a combustion chamber 1 is provided for producing hot operating gas. Any fuel may be used for firing the chamber 1, using a burner 2 which is connected to a fuel supply 2*a* and an air supply 2*b* which is supplied through a compressor 2*c*. Circulating gas is fed into the combustion chamber 1 through lines 15, a circulation fan 16 and a line 3. The mixture of circulated gas and freshly produced combustion gas flows through a line 4*a* and a hot gas bend 4 to a feeder 5. A storage bin 6 for finely ground coal is equipped with a metering device 7 which conveys coal through a line to the feeder centrifuge 8.

The gas stream is directed upwardly from a flash tube 9 into which the coal is catapulted. A screening device 10 provides the separation of the coarse grain and includes a return line 11 with a star feeder 11*a* and a feeder centrifuge 11*b*. This device 11*b* is intended for returning the coarse grain which, during the single passage through the flash tube 9, has not attained the necessary temperature, and to convey this grain once more through the flash tube to further raise its temperature. The conveying gas has a temperature of about 650° C. to 700° C. and, at the end of the flash tube, this gas heats the coal up to about 200° C. to 230° C.

Coal and conveying gas pass through a line 10*a* to separator 12 in which the greatest part of the coal is separated from the gas stream. The fine coal dust which has not been separated in separator 12 passes, with the conveying gas, to a bend 12*a* and the high efficiency separator 13 which is assembled of a battery of parallel connected cyclones having a smaller diameter. The operating gas which now only contains a small amount of coal dust and is loaded with the moisture of the entire coke coal and cooled down is further conveyed through a line 14 and has a temperature of only about 280° C. to 300° C.

One part of this gas stream passes through a pipe 15 back to a circulation fan 16, whereby, the circuit of the operating gas is closed. The gas portion which is not circulated in the circuit pipe 15 passes through a branch line 17 into a wet scrubber 18 from where the coal mud is removed through a line 18*a* and the purified waste gas is evacuated through a line 18*b* and a fan 18*c*. The coke coal accumulated in separator 12 is supplied through a star feeder 12*b* and the fine fraction collected in separator 13 is supplied through feed screw 13*a* and lines 12*c* and 13*b* to the closed conveying element 19 from where the coal is transported to the coke oven plant. A water seal pan is shown at 4*b* and it serves to receive grain of excess size which is not conveyed by the operating gas.

FIG. 2 is a simple showing of the method in accordance with the invention, in which, as in the method of FIG. 1, in order to produce fresh operating gas, the combustion waste gases are mixed with cooled return gases so that an operating gas circuit is formed. The fine dust obtained in separator 13 is supplied through feed screw 13*a* and line 13*c* to an accumulator 21 and is discharged by a metering device 33 into a line 22. Metering device 33 discharges an amount of coal dust corresponding exactly to the instantaneous requirement of the plant. This amount is supplied to combustion chamber 23. To obtain the heat amount needed for the preheating of the coal at any desired time, separator 13 is designed, in accordance with the invention, for varying its separating efficiency, with the amount of fine coal dust stored in accumulator 21 serving as the controlled variable for the amount to be removed.

The operating gases flowing out of combustion chamber 23 through line 4*a* are mixed with the return gases from line 3*a* and 3*b* by means of control device 3*c* and have such a small oxygen content that a secure operation of the preheating plant is insured. In the single stage heating system shown, the waste gases to be evacuated through line 24 leave with a temperature of about 250° C. to 300° C., and are supplied through line 24 to a heat exchanger 25. The combustion air is supplied to the heat exchanger through a line 25*a* directly to combustion chamber 23 and is evacuated through a line 26.

The conveying air is also preheated in the heat exchanger 25 and it is supplied through a line 25*b* and removed through a line 22 which is loaded with coal dust from metering device 33 and is then supplied to the combustion chamber 23. The waste gases escaping through line 27 from heat exchanger 25 still have a temperature of about 200° C., so that they can be supplied selectively to an electrofilter or to a wet scrubber. Without the heat exchanger 25, the waste gases would have a temperature of 250° C. to 300° C. and the installation of an electrifier would be possible only with particular safety measures.

The embodiment of FIG. 2 includes a wet scrubber 18, and the coal mud which is obtained is drained through a line 28 and supplied to a mud drier 28*a*. The drier receives heating steam through a line 28*b* and the condensate is drained through a line 28*c*. Any waste steam may be used for drying the coal mud. The coal dust obtained in the drier is removed through a line 31 and supplied to accumulator 21. The needed steam is produced in heat exchanger 30 from where soft water is drained through a line 32*a* and the steam is removed through a line 32*b* with line 32*b* being connected to line 28*b*.

In order to produce the additionally needed heat, a corresponding additional amount of coal dust is supplied to combustion chamber 23. This is done, in accordance with the invention, by correspondingly increasing the separation efficiency of material separator 13. The steam produced in the heat exchanger 30 may also be supplied to the gas-collecting main of the coke oven battery, to increase the heat content of the coke oven gas in the collecting main. An auxiliary burner 34, air supply 3*d*, and control member 3*e* are provided for the purpose of starting the plant. The coarser grain separated in separator 12 and removed by conveying device 19 is transported to the coking plant and carbonized along with the other coal.

FIG. 3 shows another embodiment of the inventive method in which the hot combustion waste gases produced by burning the fine coal dust are directed through an indirect heat exchanger in which the cooled return gases containing the water from the dried coal are heated up to the operating temperature. The hot combustion waste gases, which are produced by metered supply and burning of the superfine coal dust in combustion chamber 35, are supplied through a line 36 to an indirect heat exchanger 37. The cooled return gases, which arrive through line 38 from the preheating stage, are brought in the heat exchanger 37 to the necessary operating temperature. The heated operating gases are supplied through line 39 into line 4*a*.

Heat exchanger 37 may also be used for producing steam. For this purpose, it receives soft water from a line 49*a*. The water is vaporized in a piping system 49*c* and the steam is removed through a line 49*b* and supplied to the collecting main of the coke oven battery. Cooled combustion waste gases are evacuated from heat exchanger 37 through a line 40. They are partly recycled through a line 44 comprising a control device 44*a* and lines 44*b* and 44*c* to combustion chamber 35, whereby, a circuit is formed.

The combustion waste gas not used in this circuit passes through control device 40*a* and transfers its residual heat in heat exchanger 42 to the air necessary for the combustion. This air is supplied directly to combustion chamber 35, partly through line 43 in which a fan 43*a* is provided. Another part of the combustion air preheated in heat exchanger 42 is supplied, loaded with the coal dust from accumulator 21, to combustion chamber 35, through line 22 and fan 22*a*.

In the single-stage preheating shown, comprising only one flash tube 9, the combustion waste gases leave heat exchanger 37 with temperatures of 350° C. to 400° C. They are further cooled to about 200° C. in heat exchanger 42. They are supplied through 42*a* to electrofilter 41 and from there, they are discharged into the free atmosphere through line 41*a*. Outlet 41*b* serves to remove the separated solid matter. Gas supply connection 45 serves to start the plant. Inert gas is introduced through this connection. After moist coal is fed into the plant and combustion chamber 35 is fired with any auxiliary fuel to start the plant, this extraneous inert gas atmosphere gradually becomes saturated with water vapor until the inert gas is completely displaced by the steam which is produced from the coal moisture, so that, as soon as the plant reaches the operating temperature, the operating gas is composed substantially of steam. Thus, at that time, pure steam is supplied through lines 39 and 4*a*, as well as through bend 4. Line 20 with the control member 20*a* serves the purpose of starting the plant and of closing the direct circuit through heat exchanger 37.

The material separated in separator 12 is transported by conveyors 19*a* and 19*b* to the coke oven plant and is carbonized along with the other coal. After having passed through the separating system 13, the circulated operating gas consisting essentially of steam is recycled through line 38 to heat exchanger 37, whereby, the circuit is closed. The steam amount corresponding to the coal moisture must be removed from the process and it is removed through line 46 comprising the control member 46*a* and precipitated in condensator 47, which includes a sprinkler 47*a*. Coal mud is obtained which is removed through line 50 and supplied to a drier 51.

Drier 51 may be supplied with steam through lines 49*b* and 51*a*. Condensate is drained through a line 51*b*. The dried coal mud is supplied through line 52 to accumulator 21. The installation designated by numerals 53 to 60 serves to start the plant with crude tar. Through pump 53*a* and line 53, crude tar is pumped into a storage tank 54. To keep the crude tar hot, a part of the operating steam to be allowed to escape is used. For this purpose, the steam is supplied through line 48, comprising, a control member 48*a*, to line 55, where the control member 55*a* is provided.

The condensed hot steam is drained from tank 54 through 55*b*. By means of elements 56, 58, 59 and 60, a tar circuit is maintained by which the constant viscosity of the tar is insured. The tar is supplied to combustion chamber 35 through a line 37. Of the other reference numbers, 56 is a pump, 59 and 60 are throttling members and 58 is the circulation line.

While specific embodiments of the invention have been shown and described in detail to illustrate the application of the principles of the invention, it will be understood that the invention may be embodied otherwise without departing from such principles.

What is claimed is:

1. A method of preheating coal for coking, with an immediately following carbonization thereof, comprising, directing moist coal to be coked into hot operating gases to transfer heat and preheat the coal thereby cooling the operating gases and generating steam, separating the cooled operating gases with a quantity of coal dust from the heated coal, dedusting the cooled operating gases to form dedusted and cooled operating gases and a separated fine coal dust, burning said separated fine coal dust in a combustion chamber to produce said hot operating gases, admixing at least a part of the dedusted and cooled operating gases with said hot operating gases to produce fresh operating gases, controlling the amount of the fine coal dust fraction removed from said operating gases during said dedusting step as a function of grain size by varying the maximum grain size up to which the fine coal dust is separated from the coal, storing the separated fine coal dust and using the amount stored as a controlled variable for controlling the amount of fine coal dust fraction to be removed from said operating gases during said dedusting step, and supplying a metered amount of said stored fine coal dust to the combustion chamber in which the hot operating gases are produced.

2. A method of preheating coal for coking, as claimed in claim 1, in which the dedusting step is controlled in such a way that the excess heat obtained by burning the separated fine coal dust, in addition to the heat needed for producing the operating gas, is still sufficient to produce an amount of steam corresponding to the quantity of water removed from the coal by the preheating, and directing the steam into the coke oven gases of a coking plant.

3. A method of preheating coal for coking, comprising, bringing a hot operating gas into direct contact with the coal to preheat the coal, passing the preheated coal, together with the operating gas, into a separator and operating the separator so as to effect separation of the coal from the operating gases and coal dust, passing the operating gases and the coal dust into a deduster to remove the coal dust from the operating gases, directing at least a portion of the coal dust continuously into an accumulator, directing at least a portion of the coal dust which has been removed from the operating gases to a burner and burning the coal dust with combustion air to generate the operating gases, sensing the amount of coal dust in the accumulator and regulating the separator in accordance with the amount sensed so as to produce a sufficient quantity of dust which is delivered to the accumulator to maintain it at a predetermined level.

4. A method of preheating coal for coking, as claimed in claim 3, including passing the dedusted operating gases into heat exchange relationship with combustion air and delivering the combustion air to the burner for burning with the dedusted coal.

5. A method of preheating coal for coking, as claimed in claim 14, including generating steam by the burning of the dedusted coal with the combustion air and using the steam as a portion of the operating gases.

6. A method of preheating coal for coking, as claimed in claim 3, comprising directing the dedusted operating gases into heat exchange relationship with the gases which are generated by the combustion of the dedusted coal.

* * * * *